US009445458B2

(12) United States Patent
Kirikubo et al.

(10) Patent No.: US 9,445,458 B2
(45) Date of Patent: Sep. 13, 2016

(54) INDUCTION HEATING DEVICE AND IMAGE FORMING APPARATUS HAVING THE SAME

(75) Inventors: Seiichi Kirikubo, Toyohashi (JP); Atsushi Yamaguchi, Tahara (JP); Yutaka Yamamoto, Shinshiro (JP); Takahiro Tsujimoto, Toyokawa (JP); Hiroyuki Watanabe, Toyokawa (JP); Hidenori Mine, Toyohashi (JP); Masato Ishii, Toyokawa (JP)

(73) Assignee: KONICA MINOLTA BUSINESS TECHNOLOGIES, INC., Chiyoda-Ku, Tokyo (JP)

( * ) Notice: Subject to any disclaimer, the term of this patent is extended or adjusted under 35 U.S.C. 154(b) by 1051 days.

(21) Appl. No.: 13/428,037

(22) Filed: Mar. 23, 2012

(65) Prior Publication Data

US 2012/0241442 A1 Sep. 27, 2012

(30) Foreign Application Priority Data

Mar. 25, 2011 (JP) ..... 2011-067083

(51) Int. Cl.
*H05B 6/04* (2006.01)
*H05B 6/06* (2006.01)
*G03G 15/20* (2006.01)

(52) U.S. Cl.
CPC ..... *H05B 6/06* (2013.01); *G03G 15/2039* (2013.01); *G03G 15/2053* (2013.01)

(58) Field of Classification Search
CPC ..... G03G 15/2039; H05B 6/06
USPC ..... 219/619, 660, 635, 665, 667, 666, 661, 219/663, 627, 664; 399/328, 330, 335, 336; 363/21, 37, 41, 80, 97, 131
See application file for complete search history.

(56) References Cited

U.S. PATENT DOCUMENTS 5,783,806 A * 7/1998 Hayasaki ..... 219/635
5,794,096 A * 8/1998 Okabayashi ..... 399/33

FOREIGN PATENT DOCUMENTS

JP 08-044226 A 2/1996
JP 2002-328553 A 11/2002
JP 2004-021174 A 1/2004
JP 2009-295392 A 12/2009

* cited by examiner

*Primary Examiner* — Quang Van
(74) *Attorney, Agent, or Firm* — Buchanan Ingersoll & Rooney PC

(57) ABSTRACT

An induction heating device includes: a resonant circuit provided with a coil heating a workpiece inductively and a capacitor, the coil and the capacitor being coupled in parallel with each other; a switching element coupled in series with the resonant circuit; a power supply which applies to the resonant circuit, a direct-current input voltage whose instantaneous value can be changed with the lapse of time; and a power controller which controls power to the workpiece by turning the switching element ON at a certain time and changing an ON period of the switching element, and the power controller is characterized by turning the switching element ON with a delay of an integral multiple of a resonant period of the resonant circuit if a value of power to the workpiece is equal to or lower than a first threshold which is predetermined.

18 Claims, 8 Drawing Sheets

Maximum Input Power
Signal Tr
on
OFF
on
OFF
ON Period:long
OFF Period:fixed
Voltage and
Current of Coil
IL
VL
T Reduced Input Power
Signal Tr
on
OFF
on
OFF
on
OFF
ON Period:
shorter than that in the case
of maximum input power
OFF Period:fixed
Voltage and
Current of Coil
IL
VL
ΔV
T

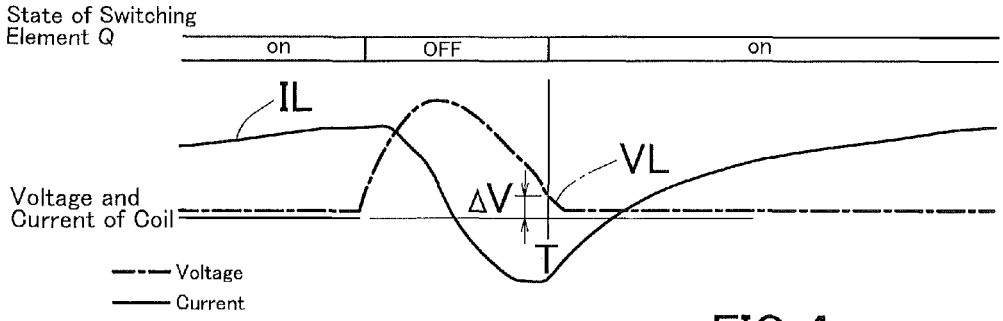
FIG.4
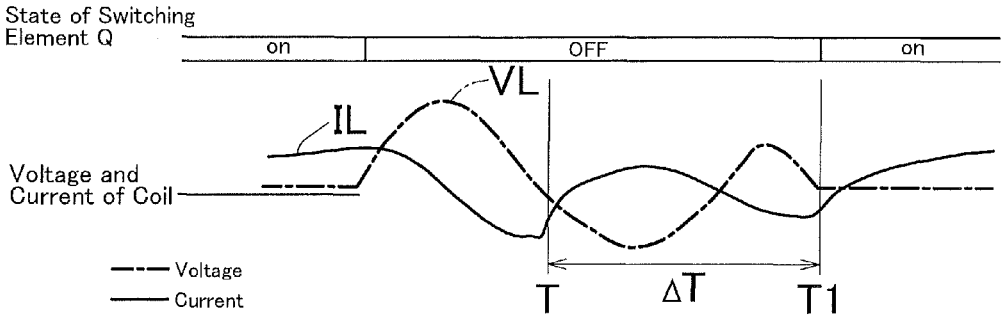
FIG.5
| Input Power | Switching Loss | Number of Delays |
|---|---|---|
| more than 600W | Small | 0 |
| equal to or less than 600W | Intermediate | 1 |
| equal to less than 400W | Large | 2 |
FIG.6

---- Voltage Detected in Both Ends of Coil
—— Input Voltage

| Input Power | Switching Loss | Number of Delays | Number of Delays Depending on Instantaneous Value of Input |
|---|---|---|---|
| more than 600W | Small | 0 | |
| equal to or less than 600W | Intermediate | 1 | higher than 40%→1<br>equal to or lower than 40%→0 |
| equal to or less than 400W | Large | 2 | higher than 60%→2<br>equal to or higher than 40→1<br>equal to or lower than 40%→0 |

| | Input Power | Upper Limit on Number of Delays |
|---|---|---|
| Case ① | more than 600W | 0 |
| Case ② | equal to or less than 600W | 2 |
| Case ③ | less than 400W | 4 |

FIG.11

| | Instantaneous Value of Input Voltage | Number of Delays |
|---|---|---|
| Pattern A | equal to or lower than 40% | 0 |
| Pattern B | higher than 40% | 2 |
| Pattern C | higher than 60% | 4 |

FIG.12

| | Input Power | Upper Limit on Number of Delays |
|---|---|---|
| Case ① | more than 500W | 0 |
| Case ② | equal to or less than 500W | 2 |
| Case ③ | less than 300W | 4 |

FIG.13

| | Input Power | Upper Limit on Number of Delays |
|---|---|---|
| Case ① | more than 700W | 0 |
| Case ② | equal to or less than 700W | 2 |
| Case ③ | less than 500W | 4 |

FIG.14

| | Instantaneous Value of Input Voltage | Number of Delays |
|---|---|---|
| Pattern A | equal to or lower than 50% | 0 |
| Pattern B | higher than 50% | 2 |
| Pattern C | higher than 70% | 4 |

FIG.15

| | Instantaneous Value of Input Voltage | Number of Delays |
|---|---|---|
| Pattern A | equal to or lower than 30% | 0 |
| Pattern B | higher than 30% | 2 |
| Pattern C | higher than 50% | 4 |

FIG.16

INDUCTION HEATING DEVICE AND IMAGE FORMING APPARATUS HAVING THE SAME

This application claims priority under 35 U.S.C. §119 to Japanese Patent Application No. 2011-067083 filed on Mar. 25, 2011, the entire disclosure of which is incorporated herein by reference in its entirety.

BACKGROUND OF THE INVENTION

1. Field of the Invention

The present invention relates to: an induction heating device serving as a source of heat, for example of a fuser of an image forming apparatus; and an image forming apparatus with this induction heating device being installed thereon.

2. Description of the Related Art

The following description sets forth the inventor's knowledge of related art and problems therein and should not be construed as an admission of knowledge in the prior art.

Some of the image forming apparatuses such as copiers, printers, and facsimiles and the multifunctional digital image forming apparatuses called as MFPs (Multi Function Peripherals), collectively having the functions of these image forming apparatuses, use an induction heating device as a source of heat for heating the fuser rollers of fusers.

Such an induction heating device, which has a resonant circuit with an induction heating coil and a capacitor being coupled in parallel with each other and a switching element constituting an IGBT (Insulated Gate Bipolar Transistor) which is coupled in series with the resonant circuit, conventionally has been employed a method of achieving control of power to the fuser rollers: performing full-wave rectification to convert a commercial AC voltage to DC; applying it to the resonant circuit; and controlling an ON period of the switching element.

Such an induction heating device having a resonant circuit and a switching element as described above makes the switching element turn power ON when the collector-emitter voltage of the switching element becomes approximately equal to the input voltage of the resonant circuit, after going up and down. Turning power ON at that time, the switching element does not have to cause much switching loss.

However, when the power to the resonant circuit is reduced by power control, the switching element cannot obtain an enough amount of current because the collector-emitter voltage decreases with reduction of the power; and while the collector-emitter voltage hardly can fall to the same level as the input voltage, the switching element has to be turned ON and OFF. As a result, the switching element causes too much switching loss and sometimes can be broken for that reason, which is why it has been difficult to achieve control of power to the fuser rollers when reducing the power.

To solve such a problem, Japanese Unexamined Patent Application No. 2002-328553 discloses a technology to reduce a switching loss of the switching element by changing the capacitance of the resonant capacitor.

And Japanese Unexamined Patent Application No. 2009-295392 discloses a technology to prevent any fusing failures by controlling the ON/OFF state of the switching element in synchronization with a zero-crossing of the AC voltage and changing the time of the control pulse of the switching element every half cycle.

However, there is a problem with the technology disclosed in Japanese Unexamined Patent Publication No. 2002-328553 that a configuration to change the capacitance of a resonant capacitor is complicated and costly.

And there is a problem with the technology disclosed in Japanese Unexamined Patent Publication No. 2009-295392 that a commercial voltage sometimes can drop to cause flickering in a lighting apparatus such as a fluorescent lamp, because of too much power to a workpiece to be inductively heated.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

A first aspect of the present invention of the subject application relates to an induction heating device comprising:

- a resonant circuit with a coil heating a workpiece inductively and a capacitor, the coil and the capacitor being coupled in parallel with each other;
- a switching element coupled in series with the resonant circuit;
- a power supply which applies to the resonant circuit, a direct-current input voltage whose instantaneous value can be changed with the lapse of time; and
- a power controller which controls power to the workpiece by turning the switching element ON at a certain time and changing an ON period of the switching element, and wherein the power controller is characterized by turning the switching element ON with a delay of an integral multiple of a resonant period of the resonant circuit if a value of power to the workpiece is equal to or lower than a first threshold which is predetermined.

A second aspect of the present invention of the subject application relates to an image forming apparatus comprising an induction heating device as a heat source to apply heat to a fuser, the induction heating device comprising:

- a resonant circuit provided with a coil heating a workpiece inductively and a capacitor, the coil and the capacitor being coupled in parallel with each other;
- a switching element coupled in series with the resonant circuit;
- a power supply which applies to the resonant circuit, a direct-current input voltage whose instantaneous value can be changed with the lapse of time; and
- a power controller which turns the switching element ON at a certain time and controls power to the workpiece by changing an ON period of the switching element, and wherein the power controller is characterized by turning the switching element ON with a delay of an integral multiple of a resonant period of the resonant circuit if a value of power to the workpiece is equal to or lower than a first threshold which is predetermined.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/ or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which:

FIG. 4 illustrates a part of the waveforms of FIG. 3, which is enlarged for better understanding;

FIG. 5 illustrates a part of the waveforms of FIG. 3, to explain an example where the switching element switches ON at a certain time after a zero-crossing;

FIG. 6 is a table including thresholds of the input power and the numbers of delays for the thresholds, which are predetermined;

FIG. 11 is a table to explain another method for determining a number of times to turn the switching element ON with a delay, including thresholds of the input power and the upper limits on the number of delays for the thresholds;

FIG. 12 is a table to explain yet another method for determining a number of times to turn the switching element ON with a delay, including instantaneous values of the input voltage and the numbers of delays for the instantaneous values;

FIG. 13 is a table including thresholds of the input power and the upper limits on the number of delays for the thresholds, along with instantaneous values of the input voltage, which is to be used if the effective value of the input voltage is higher than a predetermined one;

FIG. 14 is a table including thresholds of the input power and the upper limits on the number of delays for the thresholds, which is to be used if the effective value of the input voltage is equal to or lower than a predetermined one;

FIG. 15 is a table including thresholds of the input power and the numbers of delays for the thresholds, along with instantaneous values of the input voltage, which is to be used if the effective value of the input voltage is higher than a predetermined one; and FIG. 16 is a table including thresholds of the input power and the numbers of delays for the thresholds, along with instantaneous values of the input voltage, which is to be used if the effective value of the input voltage is equal to or lower than a predetermined one.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Hereinafter, a mode of implementing the present invention will be described with reference to the accompanying drawings.

Figure 1:
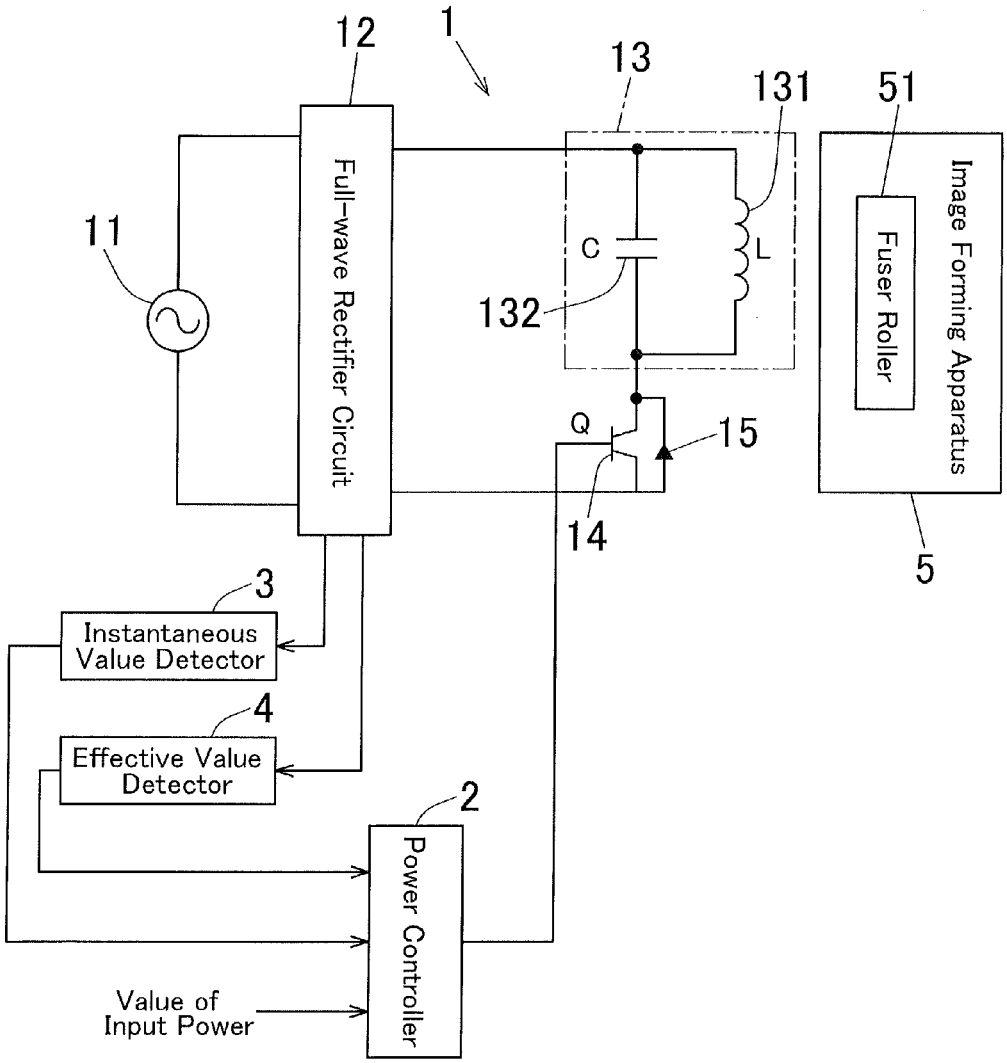
FIG. 1 is a block diagram illustrating a configuration of an induction heating device according to one mode of implementing the present invention.

FIG. 1 is a block diagram illustrating a configuration of an induction heating device according to one mode of implementing the present invention. In this mode of implementation, an induction heating device 1, which is installed on an image forming apparatus 5 such as a MFP as described above, is configured to heat fuser rollers 51 of a fuser, which serves as a workpiece to be inductively heated.

The induction heating device 1 includes a commercial power source 11, a full-wave rectifier circuit 12, a resonant circuit 13, a switching element 14, a parasitic diode 15, a power controller 2, an instantaneous value detector 3, and an effective value detector 4.

The commercial power source 11 is a power source of 100V; the full-wave rectifier circuit 12 converts a commercial AC voltage of 100V to DC by performing full-wave rectification. In this mode of implementation, the full-wave rectification 12 serves as a power source to apply an input voltage to the resonant circuit 13.

The resonant circuit 13, which consists of a coil for induction heating (inductor) 131 and a capacitor 132 coupled in parallel with each other, is configured to heat the fuser rollers 51 of the image forming apparatus 5 with the heat inductively generated by the coil 131.

The switching element 14, which is coupled in series with the resonant circuit 13, forms a closed loop starting from the full-wave rectifier circuit 12 through the resonant circuit 13 and the switching element 14, and back to the full-wave rectifier circuit 12. The switching element 14 is not limited to any particular types; for the sake of expedience, an IGBT (Insulated Gate Bipolar Transistor) is employed as the switching element 14 in this mode of implementation.

The power controller 2 achieves control of power to the fuser rollers 51 by controlling the ON/OFF state of the switching element 14 at high frequencies. More specifically, the power controller 2 achieves control of the input power by controlling an ON period of the switching element 14. In this mode of implementation, the period of time for keeping the switching element 14 to be in the OFF state is fixed in advance to a certain value.

The instantaneous value detector 3 detects an instantaneous value of the input voltage after full-wave rectification is performed by the full-wave rectifier circuit 12. The detection of an instantaneous value may be achieved by any of the heretofore known methods, for example by a method of dividing the input voltage to compare to the peak voltage (crest value).

The effective value detector 4 detects an effective value of the input voltage after full-wave rectification is performed by the full-wave rectifier circuit 12. The detection of an effective value may be achieved by any of the heretofore known methods.

The instantaneous value detected by the instantaneous value detector 3 and the effective value detected by the effective value detector 4 are inputted to the power controller 2. The power controller 2 achieves control of power to the fuser rollers 51 by determining an ON period of the switching element based on a value of input power or based on a value of input power and the instantaneous value of the input voltage detected by the instantaneous value detector 3 and/or the effective value of the input voltage detected by the effective value detector 4 as well as a value of input power.

FIG. 2 is a view of a principal part of the induction heating device 1, to explain the operation to be performed by the resonant circuit 13 depending on the ON/OFF state of the switching element 14. Here in this Figure, while the switching element 14 is illustrated as a switch simply, the input voltage to be applied to the resonant circuit 13 by the full-wave rectifier circuit 12 is represented by V0.

Figure 2A:
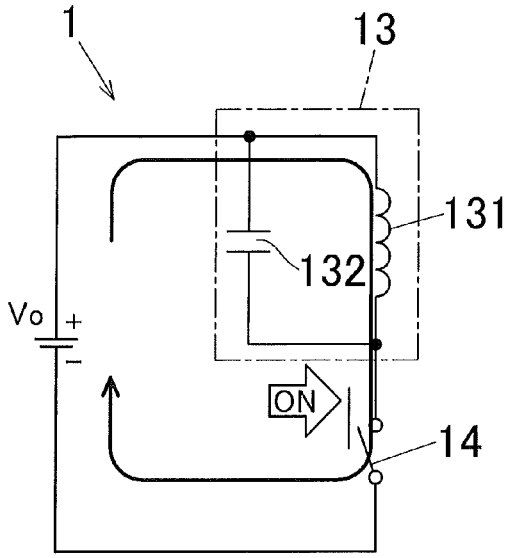
FIG. 2 is a view of a principal part of the induction heating device, to explain the operation to be performed by a resonant circuit depending on the ON/OFF state of the switching element.
Figure 2B:
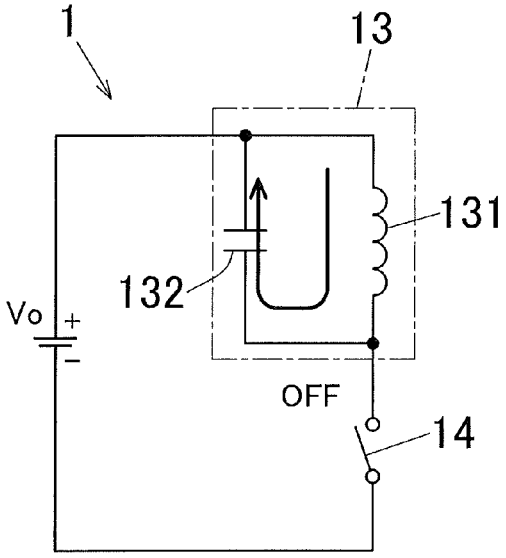

When the switching element 14 is turned ON, as illustrated in FIG. 2A, the input voltage V0 allows a current to reach the coil 131; and the current value grows as time advances. When the switching element 14 is turned OFF, as illustrated in FIG. 2B, the current, which has passed through the coil 131, reaches the capacitor 132 to charge. That makes the collector-emitter voltage of the switching element 14 rise. If Vc is provided to indicate the charging voltage of the capacitor 132, the collector-emitter voltage should be represented by (V0+Vc).

Figure 2C:
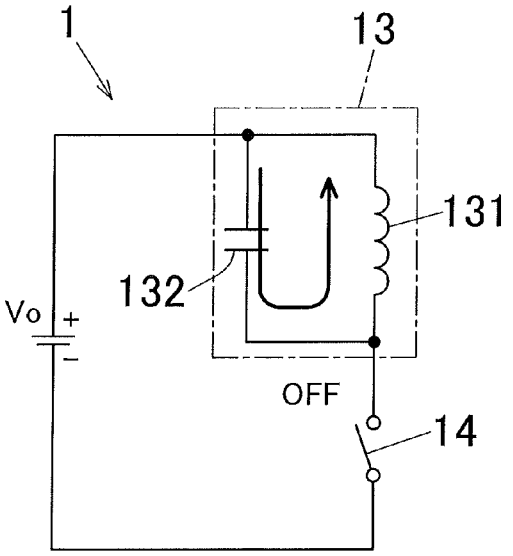

When the charging voltage of the capacitor 132 becomes equal to the input voltage V0, as illustrated in FIG. 2C, the current is cut off and the capacitor 132 starts discharging to transfer current to the coil 131. That makes the collector-emitter voltage of the switching element 14 fall.

Figures 3A, 3B:
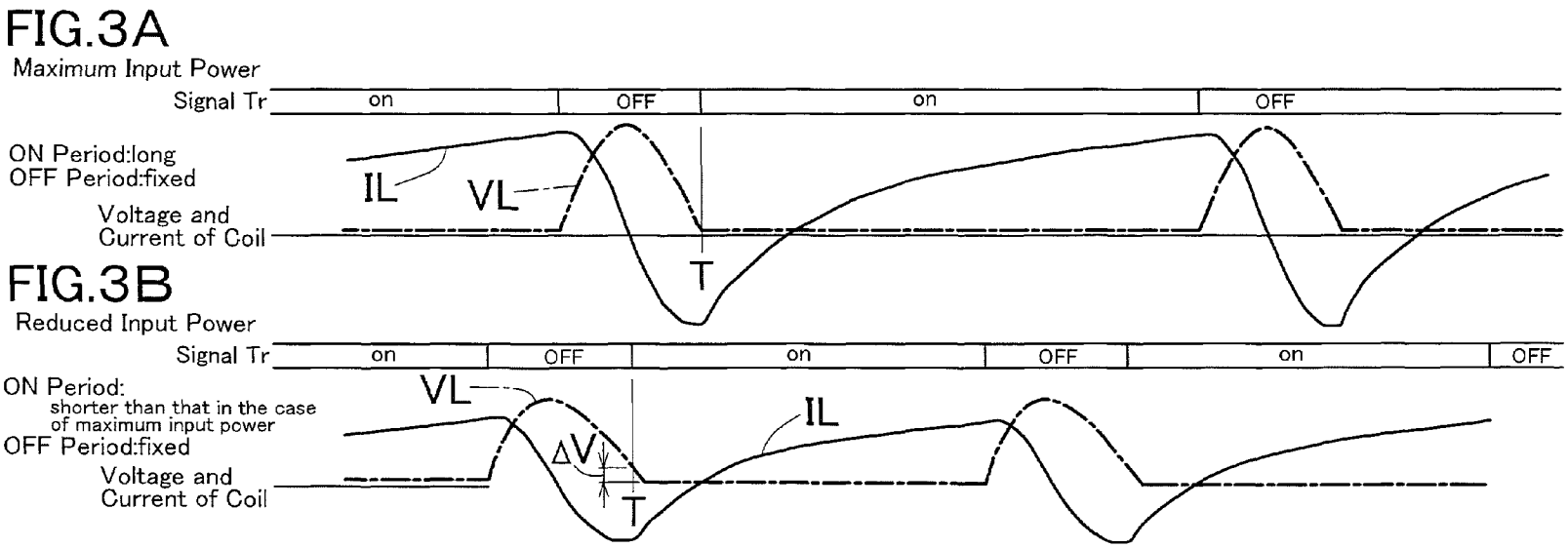
FIG. 3 illustrates the waveforms of a voltage and current to be detected on the end of a coil next to the switching element during the operation of the resonant circuit.

FIG. 3A illustrates the waveforms of a voltage VL and a current IL to be detected on the end of the coil 131 next to the switching element 14 during the operation of the resonant circuit 13. In FIG. 3, a signal to turn the switching element 14 ON or OFF is represented by Tr. When the switching element 14 is turned OFF, as can be understood from this Figure, the capacitor 132 is started to be charged and less current reaches to the coil 131, making the voltage VL rise. When the voltage VL peaked to be equal to the input voltage V0, the current IL falls to zero and the capacitor 132 starts discharging to transfer current.

Figure 2D:
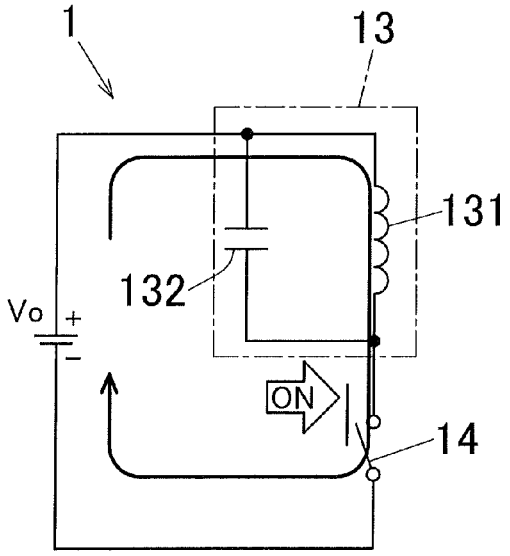

After the capacitor 132 finishes discharging, the voltage VL to be detected on the end of the coil 131 next to the switching element 14, becomes equal to the input voltage V0 at a time T, and as illustrated in FIG. 2D, the switching element 14 is turned ON at this time. As described above, it is only necessary to turn the switching element 14 ON when the collector-emitter voltage of the switching element 14 falls to the same level as the input voltage V0, preventing a switching loss of the switching element 14.

The period of time for keeping the switching element 14 to be in the OFF state is fixed in advance to a certain value based on the resonant frequency, because the time to turn the switching element 14 ON is different depending on the resonant frequency of the resonant circuit 13.

And when the switching element 14 is turned ON, the input voltage V0 allows the current IL to reach to the coil 131 and then the resonant circuit 13 will repeat the same routine.

However, when the power to the fuser rollers 51 is reduced by power control, an enough amount of the current IL cannot reach to the coil 131 and the voltages to be detected on the both ends of the coil 131 cannot fall to a preferred value; as illustrated in FIG. 3B, and in more detail in FIG. 4, the switching element 14 has to be turned ON at the time T with the presence of a difference ΔV between the input voltage V0 and the collector-emitter voltage. This will cause too much switching loss.

To solve such a trouble, in this mode of implementation, when there is a difference ΔV between the input voltage V0 and the collector-emitter voltage, i.e. when the power to the fuser rollers 51 is reduced by power control, the switching element 14 is turned ON with a delay of a time ΔT after the time T. And the time ΔT is set equal to an integral multiple of a resonant period of the resonant circuit 13.

As described above, it is only necessary to turn the switching element 14 ON with a certain amount of delay in order to reduce the number of delays and reduce a switching loss per unit time. Furthermore, there is no need to prepare a complicated and costly configuration to change the capacitance of the capacitor 132 of the resonant circuit 13 and a commercial voltage does not drop to cause flickering in a lighting apparatus, achieving control of the input power with a high degree of accuracy even when reducing the input power.

And after turning the switching element 14 ON with a certain amount of delay, a regenerative current reaches to the coil 131 through the parasitic diode 15, and when finishes discharging, the capacitor 132 is started to be charged through the coil 131, which routine is repeatedly performed every resonant period of the resonant circuit 13. In other words, the more times the resonant period is repeated (the more amount of delay or the greater number of delays becomes), the less switching loss is caused for a particular period of time.

When the input power is further reduced by power control, the induction heating device 1 cannot control the ON/OFF state of the switching element 14 because of too weak resonance. To prevent such a trouble, the input power should be kept to no less than a minimum.

In this mode of implementation, the power controller 2 controls the ON/OFF state of the switching element 14 based on a table stored on the power controller 2 itself, which includes one or more than one threshold of the input power and the number(s) of delays for the threshold(s), which are predetermined.

FIG. 6 is one example of such a table mentioned above. In this example, the number of delays should be predetermined to be "0" for the case where the input power is greater than 600 W, because a switching loss is estimated to be small in this case and it will be not necessary to turn the switching element 14 ON with any delay. The number of delays should be predetermined to be "1" for the case where the input power is equal to 600 W or a value of between 400 W and 600 W, because a switching loss is estimated to be intermediate in size in this case. The number of delays should be predetermined to be "2" for the case where the input power is equal to or smaller than 400 W, because a switching loss is estimated to be large in this case.

In this table, as described above, there is one or more than one threshold predetermined for the input power and there is a number of times to turn the switching element 14 ON with a delay, which is predetermined for each threshold for the input power. By comparing the present condition to this table, the power controller 2 is allowed to determine a number of delays without any difficulties. The less power is supplied to the fuser rollers 51, the greater the number of delays becomes, which can minimize a switching loss due to too little power to the fuser rollers 51 properly.

Here, an amount of the input power may be an actual measured value or a set value generated according to need. The induction heating device 1 may generate a set value according to the instructions entered directly from the induction heating device 1, or remotely entered from an external device such as the image forming apparatus 5.

Figure 7:
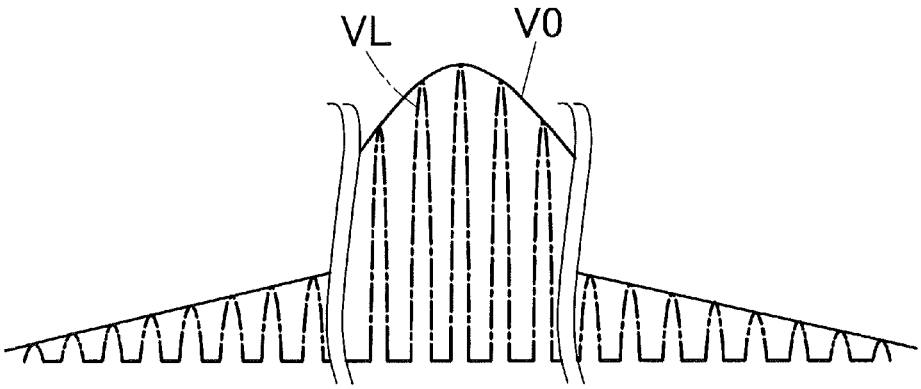
FIG. 7 illustrates waveforms, one of which indicates an original voltage and the other of which indicates a voltage converted from the original one.
Figure 8A:
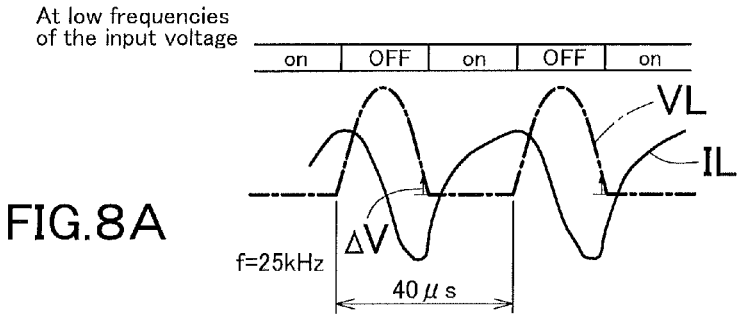
FIGS. 8A and 8B are waveforms to explain that an instantaneous value of the input voltage can impact on the voltages to be detected on the both ends of the coil.
Figure 8B:
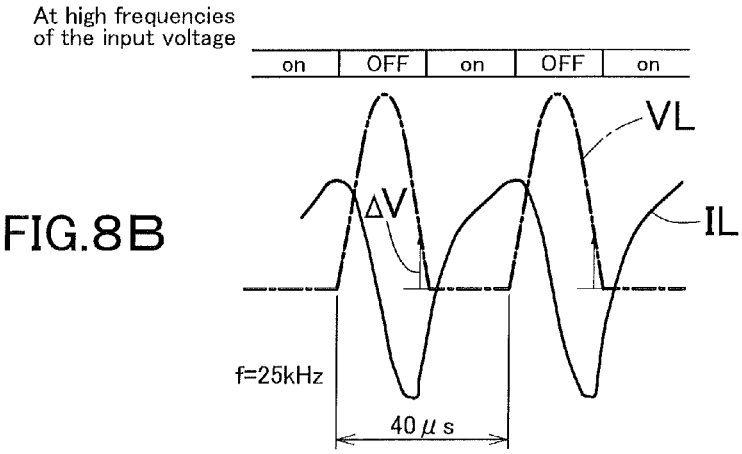

By the way, an instantaneous value of the input voltage V0 which is applied to the resonant circuit 13 can be changed with the lapse of time because it is originally converted from an AC current by full-wave rectification. Also, as illustrated in FIG. 7, an instantaneous value of the input voltage V0 affects the voltage VL to be detected on the both ends of the coil 131. Resulting in that, as illustrated in FIG. 8A, the difference ΔV between the input voltage V0 and the collector-emitter voltage is small at low frequencies of the input voltage V0 (in the area in which the instantaneous value is low) and is large at high frequencies of the input voltage V0 (in the area in which the instantaneous value is high) at the time T.

In order to prevent such instability, it is preferred to determine a number of times to turn the switching element 14 ON with a delay, based on the instantaneous value of the input voltage V0, when less power is supplied to the fuser rollers 51. As described above, power reduction using an instantaneous value of the input voltage V0 which is applied to the resonant circuit 13 makes it possible to achieve control of the input power with a higher degree of accuracy.

Figures 9, 10:
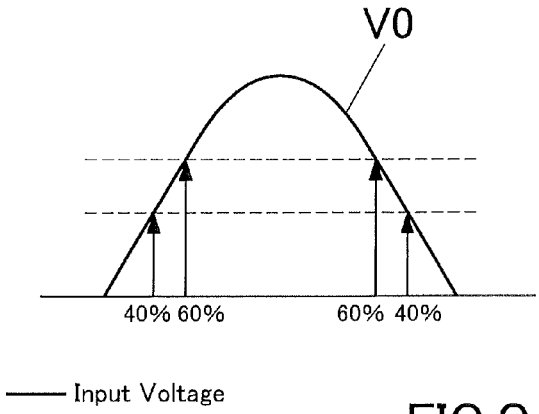
FIG. 9 illustrates a waveform to explain thresholds of the instantaneous value of the input voltage.
FIG. 10 is a table including thresholds of the input power and the numbers of delays for the thresholds, along with instantaneous values of the input voltage.

In this mode of implementation, there are the following thresholds of the instantaneous value: 40% and 60% of the crest value, in a waveform of the input voltage V0 as illustrated in FIG. 9; a number of delays is determined based on these thresholds.

More specifically, as shown in the table of FIG. 10, the number of delays should be predetermined to be "0" for the case where the input power is greater than 600 W, because a switching loss is estimated to be small in this case; the number of delays should be predetermined to be "1" for the case where the input power is equal to 600 W or a value of between 400 W and 600 W and the instantaneous value of the input voltage V0 is higher than 40% of the crest value; and the number of delays should be predetermined to be "0" for the case where the input power is equal to 600 W or a value of between 400 W and 600 W and the instantaneous value of the input voltage V0 is equal to or lower than 40% of the crest value, because a switching loss is estimated to be small in this case. And the number of delays should be predetermined to be "2" for the case where the input power is smaller than 400 W and the instantaneous value of the input voltage V0 is higher than 60% of the crest value; the number of delays should be predetermined to be "1" for the case where the input power is smaller than 400 W and the instantaneous value of the input voltage V0 is equal to 60% of the crest value or a value of between 40% and 60% of the crest value; and the number of delays should be predetermined to be "0" for the case where the input power is smaller than 400 W and the instantaneous value of the input voltage V0 is equal to or lower than 40% of the crest value. According to this table, the power controller 2 controls the ON/OFF state of the switching element 14.

FIGS. 11 and 12 illustrate tables to explain other methods for determining a number of times to turn the switching element 14 ON with a delay, based on an instantaneous value of the input voltage V0.

Before giving explanation, it should be noted that an upper limit on the number of delays needs to be predetermined for each threshold of the input power. For example, as shown in the table of FIG. 11, the upper limit on the number of delays should be predetermined to be "0" for the case where the input power is greater than 600 W (Case 1); the upper limit on the number of delays should be predetermined to be "2" for the case where the input power is equal to 600 W or a value of between 400 W and 600 W (Case 2); and the upper limit on the number of delays should be predetermined to be "4" for the case where the input power is equal to or less than 400 W (Case 3).

On the other hand, it also should be noted that a number of delays needs to be predetermined for each threshold of the input voltage V0. For example, as shown in the table of FIG. 12, the number of delays should be predetermined to be "0" for the case where the instantaneous value is equal to or lower than 40% of the crest value (Case A); the number of delays should be predetermined to be "2" for the case where the instantaneous value is equal to 60% of the crest value or a value of between 40% and 60% of the crest value (Case B); and the number of delays should be predetermined to be "4" for the case where the instantaneous value is higher than 60% of the crest value (Case C).

And if the number of delays determined based on the instantaneous value of the input voltage V0 according to FIG. 12, is equal to or lower than the upper limit for the threshold of the input power in FIG. 11, the number of delays determined according to FIG. 12 is accepted. If the number of delays determined based on the instantaneous value of the input voltage V0 according to FIG. 12 is greater than the upper limit for the threshold of the input power in FIG. 11, the upper limit for the threshold of the input power in FIG. 11 is accepted. The number of thresholds and the numbers of delays for the thresholds need to be predetermined in an arbitrary manner.

When the input power is reduced by power control, as mentioned above, the switching element 14 cannot obtain an enough amount of current because the collector-emitter voltage decreases with reduction of the power; and while the collector-emitter voltage hardly can fall to the same level as the input voltage V0, the switching element 14 has to be turned ON and OFF. This will cause too much switching loss. However, if the effective value of the input voltage V0 is high enough, much switching loss hardly will be caused even with the reduced and small input power, which means that the thresholds of the input power can be lowered. On the other hand, if the effective value of the input voltage V0 is too low, much switching loss easily will be caused with the reduced and small input power, which means that the thresholds of the input power need to be raised.

In this mode of implementation, such an inconvenience, which occurs if the effective value of the input voltage V0 is higher than a predetermined value, can be solved by lowering the predetermined thresholds in the table of FIG. 11 by 100 W, as shown in the table of FIG. 13: the upper limit on the number of delays should be predetermined to "0" for the case where the input power is greater than 500 W (Case 1); the upper limit on the number of delays should be predetermined to "2" for the case where the input power is equal to 500 W or a value of between 300 W and 500 W (Case 2); and the upper limit on the number of delays should be predetermined to "4" for the case where the input power is equal to or smaller than 300 W (Case 3).

On the other hand, such an inconvenience, which occurs if the effective value of the input voltage V0 is equal to or lower than a predetermined value, can be solved by raising the predetermined thresholds in the table of FIG. 11 by 100 W, as shown in the table of FIG. 14: the upper limit on the number of delays should be predetermined to "0" for the case where the input power is greater than 700 W (Case 1); the upper limit on the number of delays should be predetermined to "2" for the case where the input power is equal to 700 W or a value of between 500 W and 700 W (Case 2); and the upper limit on the number of delays should be predetermined to "4" for the case where the input power is equal to or smaller than 500 W (Case 3).

All the thresholds of the input power do not need to be lowered or raised by the same amount; those may be lowered or raised by different amounts.

Furthermore, if the effective value of the input voltage V0 is high enough, much switching loss hardly will be caused even with the reduced and small input power, which also means that the thresholds of the instantaneous value of the input voltage V0 can be raised. On the other hand, if the effective value of the input voltage V0 is too low, much switching loss easily will be caused with the reduced and small input power, which also means that the thresholds of the instantaneous value of the input voltage V0 need to be lowered.

In this mode of implementation, such an inconvenience, which occurs if the effective value of the input voltage V0 is higher than a predetermined value, can be solved also by raising the predetermined thresholds in the table of FIG. 12 by 10%, as shown in the table of FIG. 15: the number of delays should be predetermined to "0" for the case where the instantaneous value of the input voltage V0 is equal to or lower than 50% of the crest value (Case A); the number of delays should be predetermined to "2" for the case where the instantaneous value of the input voltage V0 is equal to 70% of the crest value or a value of between 50% and 70% of the crest value (Case B); and the number of delays should be predetermined to "4" for the case where the instantaneous value of the input voltage V0 is greater than 70% of the crest value (Case C).

On the other hand, such an inconvenience, which occurs if the effective value of the input voltage V0 is equal to or lower than a predetermined value, can be solved by lowering the predetermined thresholds in the table of FIG. 12 by 10%, as shown in the table of FIG. 16: the number of delays should be predetermined to be "0" for the case where the instantaneous value is equal to or lower than 30% of the crest value (Case A); the number of delays should be predetermined to be "2" for the case where the instantaneous value is equal to 50% of the crest value or a value of between 30% and 50% of the crest value (Case B); and the number of delays should be predetermined to be "4" for the case where the instantaneous value is higher than 50% of the crest value (Case C).

One mode of implementing the present invention has been described in the foregoing specification, which does not mean that the present invention shall be construed as limited to the particular forms disclosed.

For example, the induction heating device 1 is employed for the image forming apparatus 5 in this mode of implementation, but is not limited to this particular use.

The present invention of the subject application having been described above may be applied to the following modes.

[1] An induction heating device comprising:

a resonant circuit provided with a coil heating a workpiece inductively and a capacitor, the coil and the capacitor being coupled in parallel with each other;

a switching element coupled in series with the resonant circuit;

a power supply which applies to the resonant circuit, a direct-current input voltage whose instantaneous value can be changed with the lapse of time; and a power controller which controls power to the workpiece by turning the switching element ON at a certain time and changing an ON period of the switching element, and wherein the power controller is characterized by turning the switching element ON with a delay of an integral multiple of a resonant period of the resonant circuit if a value of power to the workpiece is equal to or lower than a first threshold which is predetermined.

[2] The induction heating device as recited in the aforementioned item [1], wherein:

there is one or more than one threshold predetermined for the value of power to the workpiece and there is an amount of delay required to turn the switching element ON, which is predetermined for each threshold; and the power controller selects an amount of delay required to turn the switching element ON, among those predetermined, based on the thresholds and the value of power to the workpiece.

[3] The induction heating device as recited in the aforementioned item [2], wherein:

the thresholds include the first threshold and a second threshold which is lower than the first threshold;

an amount of delay required to turn the switching element ON, which is determined by the power controller if the value of power to the workpiece is equal to or lower than the second threshold, is greater than that determined by the power controller if the value of power to the workpiece is equal to the first threshold or a value of between the first threshold and the second threshold.

[4] The induction heating device as recited in any of the aforementioned items [1] to [3], further comprising an instantaneous value detector which detects an instantaneous value of the input voltage, wherein the power controller turns the switching element ON with an amount of delay selected based on the instantaneous value of the input voltage detected by the instantaneous value detector.

[5] The induction heating device as recited in any of the aforementioned items [2] to [5], wherein:

there is one or more than one threshold predetermined for the instantaneous value of the input voltage; and the power controller turns the switching element ON with an amount of delay selected based on the thresholds for the value of power to the workpiece and the thresholds for the instantaneous value of the input voltage detected by the instantaneous value detector.

[6] The induction heating device as recited in the aforementioned item [4] or [5], wherein the power controller turns the switching element ON without any delay, if the instantaneous value of the input voltage detected by the instantaneous value detector is equal to or lower than a third threshold while the value of power to the workpiece is equal to the first threshold or a value of between the first threshold and the second threshold.

[7] The induction heating device as recited in the aforementioned item [6], wherein: the power controller turns the switching element ON without any delay, if the instantaneous value of the input voltage is equal to or lower than the third threshold while the value of power to the workpiece is equal to or lower than the second threshold; the power controller turns the switching element ON with a delay, if the instantaneous value of the input voltage is equal to a fourth threshold or a value of between the third threshold and the fourth threshold while the value of power to the workpiece is equal to or lower than the second threshold; and the power controller turns the switching element ON with more delay, if the instantaneous value of the input voltage is higher than the fourth threshold while the value of power to the workpiece is equal to or lower than the second threshold.

[8] The induction heating device as recited in any of the aforementioned items [1] to [7], wherein: the threshold for the value of power to the workpiece is lowered, if an effective value of the input voltage is higher than a certain value; and the threshold for the value of power to the workpiece is raised, if an effective value of the input voltage is equal to or lower than the certain value.

[9] The induction heating device as recited in any of the aforementioned items [5] to [8], wherein: the threshold for the instantaneous value of the input voltage is lowered, if an effective value of the input voltage is higher than a certain value; and the threshold for the instantaneous value of the input voltage is raised, if an effective value of the input voltage is equal to or lower than the certain value.

[10] An image forming apparatus comprising the induction heating device as recited in any of the aforementioned items [1] to [9], as a heat source to apply heat to a fuser.

According to the invention described in the aforementioned item [1], the power controller turns the switching element ON with a delay of an integral multiple of a resonant period of the resonant circuit, if a value of power to the workpiece is equal to or lower than a first threshold which is predetermined. With this feature, the invention makes it possible to successfully reduce a switching loss per unit time to be caused with reduction of the input power, and thus achieve control of the input power with a high degree of accuracy. The invention further makes it possible to successfully reduce the input power without requiring a complicated and costly configuration to change the capacitance of a capacitor of the resonant circuit or causing a flickering in a lighting apparatus due to voltage drop.

According to the invention described in the aforementioned item [2], there is one or more than one threshold predetermined for the amount of the input power and there is an amount of delay required to turn the switching element ON, which is predetermined for each threshold. And the power controller simply selects an amount of delay among those predetermined, based on the thresholds and the value of power to the workpiece.

According to the invention described in the aforementioned item [3], an amount of delay required to turn the switching element ON, which is determined by the power controller if the current amount of the input power is equal to or lower than the second threshold, is greater than that determined by the power controller if the current amount of the input power is equal to the first threshold or a value of between the first threshold and the second threshold. With this feature, the invention makes it possible to prevent a switching loss from growing with reduction of the power to the workpiece.

According to the invention described in the aforementioned item [4], the power controller selects an amount of delay based on an instantaneous value of the input voltage of the resonant circuit, which is detected by the instantaneous value detector, and turns the switching element ON with the selected amount of delay. With this feature, the invention makes it possible to achieve control of the input power with a high degree of accuracy based on an instantaneous value of the input voltage to the resonant circuit.

According to the invention described in the aforementioned item [5], the power controller simply selects an amount of delay based on the thresholds for the amount of the input power and the thresholds for the instantaneous value of the input voltage detected by the instantaneous value detector and turns the switching element ON with the selected amount of delay.

According to the invention described in the aforementioned item [6], the power controller turns the switching element ON without any delay if the instantaneous value of the input voltage is equal to or lower than a third threshold while the current amount of the input power is equal to a first threshold or a value of between the first threshold and a second threshold. The invention makes it possible to prevent the switching element from being turned ON with delay if a switching loss would not be affected by the instantaneous value of the input voltage.

According to the invention described in the aforementioned item [7], the invention makes it possible to achieve optimal control of the input power with a high degree of accuracy based on an instantaneous value of the input voltage.

According to the invention described in the aforementioned item [8], the invention makes it possible to achieve control of the input power with a high degree of accuracy based on an effective value of the input voltage.

According to the invention described in the aforementioned item [9], the invention makes it possible to achieve control of the input power with a high degree of accuracy based on an effective value of the input voltage and an instantaneous value of the input voltage.

According to the invention described in the aforementioned item [10], an image forming apparatus, which has an induction heating device as a heat source to apply heat to a fuser, is allowed to reduce a switching loss per unit time to be caused with reduction of the power to a workpiece.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. An induction heating device comprising:

a resonant circuit provided with a coil heating a workpiece inductively and a capacitor, the coil and the capacitor being coupled in parallel with each other;

a switching element coupled in series with the resonant circuit;

a power supply which applies to the resonant circuit, a direct-current input voltage whose instantaneous value can be changed with the lapse of time; and a power controller which controls power to the workpiece by turning the switching element ON at a certain time and changing an ON period of the switching element and turns the switching element ON after a delay of an integral multiple of a resonant period of the resonant circuit when a value of power to the workpiece is equal to or lower than a first threshold which is predetermined, the delay of the integral multiple of the resonant period of the resonant circuit being longer than a delay when the value of power to the workpiece is greater than the first threshold.

2. The induction heating device as recited in claim 1, wherein:

there is one or more than one threshold predetermined for the value of power to the workpiece and there is an amount of delay required to turn the switching element ON, which is predetermined for each threshold; and the power controller selects an amount of delay required to turn the switching element ON, among those predetermined, based on the thresholds and the value of power to the workpiece.

3. The induction heating device as recited in claim 2, wherein:

the thresholds include the first threshold and a second threshold which is lower than the first threshold;

an amount of delay required to turn the switching element ON, which is determined by the power controller when the value of power to the workpiece is equal to or lower than the second threshold, is greater than that determined by the power controller when the value of power to the workpiece is equal to the first threshold or a value of between the first threshold and the second threshold.

4. The induction heating device as recited in claim 1, further comprising an instantaneous value detector which detects an instantaneous value of the input voltage, wherein the power controller turns the switching element ON after an amount of delay selected based on the instantaneous value of the input voltage detected by the instantaneous value detector.

5. The induction heating device as recited in claim 2, wherein:

there is one or more than one threshold predetermined for the instantaneous value of the input voltage; and the power controller turns the switching element ON after an amount of delay selected based on the thresholds for the value of power to the workpiece and the thresholds for the instantaneous value of the input voltage detected by the instantaneous value detector.

6. The induction heating device as recited in claim 4, wherein the power controller turns the switching element ON after no delay, when the instantaneous value of the input voltage detected by the instantaneous value detector is equal to or lower than a third threshold while the value of power to the workpiece is equal to the first threshold or a value of between the first threshold and the second threshold.

7. The induction heating device as recited in claim 6, wherein: the power controller turns the switching element ON after no delay, when the instantaneous value of the input voltage is equal to or lower than the third threshold while the value of power to the workpiece is equal to or lower than the second threshold; the power controller turns the switching element ON after a delay, when the instantaneous value of the input voltage is equal to a fourth threshold or a value of between the third threshold and the fourth threshold while the value of power to the workpiece is equal to or lower than the second threshold; and the power controller turns the switching element ON after more delay, when the instantaneous value of the input voltage is higher than the fourth threshold while the value of power to the workpiece is equal to or lower than the second threshold.

8. The induction heating device as recited in claim 1, wherein: the threshold for the value of power to the workpiece is lowered, when an effective value of the input voltage is higher than a certain value; and the threshold for the value of power to the workpiece is raised, when an effective value of the input voltage is equal to or lower than the certain value.

9. The induction heating device as recited in claim 5, wherein: the threshold for the instantaneous value of the input voltage is lowered, when an effective value of the input voltage is higher than a certain value; and the threshold for the instantaneous value of the input voltage is raised, when an effective value of the input voltage is equal to or lower than the certain value.

10. An image forming apparatus comprising an induction heating device as a heat source to apply heat to a fuser, the induction heating device comprising:

a resonant circuit provided with a coil heating a workpiece inductively and a capacitor, the coil and the capacitor being coupled in parallel with each other;

a switching element coupled in series with the resonant circuit;

a power supply which applies to the resonant circuit, a direct-current input voltage whose instantaneous value can be changed with the lapse of time; and a power controller which turns the switching element ON at a certain time and controls power to the workpiece by changing an ON period of the switching element and turns the switching element ON after a delay of an integral multiple of a resonant period of the resonant circuit when a value of power to the workpiece is equal to or lower than a first threshold which is predetermined, the delay of the integral multiple of the resonant period of the resonant circuit being longer than a delay when the value of power to the workpiece is greater than the first threshold.

11. The image forming apparatus as recited in claim 10, wherein:

there is one or more than one threshold predetermined for the value of power to the workpiece and there is an amount of delay required to turn the switching element ON, which is predetermined for each threshold; and the power controller selects an amount of delay required to turn the switching element ON, among those predetermined, based on the thresholds and the value of power to the workpiece.

12. The image forming apparatus as recited in claim 11, wherein:

the thresholds include the first threshold and a second threshold which is lower than the first threshold;

an amount of delay required to turn the switching element ON, which is determined by the power controller when the value of power to the workpiece is equal to or lower than the second threshold, is greater than that determined by the power controller when the value of power to the workpiece is equal to the first threshold or a value of between the first threshold and the second threshold.

13. The image forming apparatus as recited in claim 10, wherein:

the induction heating device further comprises an instantaneous value detector which detects an instantaneous value of the input voltage; and the power controller turns the switching element ON after an amount of delay selected based on the instantaneous value of the input voltage detected by the instantaneous value detector.

14. The image forming apparatus as recited in claim 11, wherein:

there is one or more than one threshold predetermined for the instantaneous value of the input voltage; and the power controller turns the switching element ON after an amount of delay selected based on the thresholds for the value of power to the workpiece and the thresholds for the instantaneous value of the input voltage detected by the instantaneous value detector.

15. The image forming apparatus as recited in claim 13, wherein the power controller turns the switching element ON after no delay, when the instantaneous value of the input voltage detected by the instantaneous value detector is equal to or lower than a third threshold while the value of power to the workpiece is equal to the first threshold or a value of between the first threshold and the second threshold.

16. The image forming apparatus as recited in claim 15, wherein: the power controller turns the switching element ON after no delay, when the instantaneous value of the input voltage is equal to or lower than the third threshold while the value of power to the workpiece is equal to or lower than the second threshold; the power controller turns the switching element ON after a delay, when the instantaneous value of the input voltage is equal to a fourth threshold or a value of between the third threshold and the fourth threshold while the value of power to the workpiece is equal to or lower than the second threshold; and the power controller turns the switching element ON after more delay, when the instantaneous value of the input voltage is higher than the fourth threshold while the value of power to the workpiece is equal to or lower than the second threshold.

17. The image forming apparatus as recited in claim 10, wherein: the threshold for the value of power to the workpiece is lowered, when an effective value of the input voltage is higher than a certain value; and the threshold for the value of power to the workpiece is raised, when an effective value of the input voltage is equal to or lower than the certain value.

18. The image forming apparatus as recited in claim 14, wherein: the threshold for the instantaneous value of the input voltage is lowered, when an effective value of the input voltage is higher than a certain value; and the threshold for the instantaneous value of the input voltage is raised, when an effective value of the input voltage is equal to or lower than the certain value.

* * * * *